United States Patent [19]

Prudente

[11] 4,144,581

[45] Mar. 13, 1979

[54] AUDIO SIGNAL PROCESSOR

[76] Inventor: Andrew Prudente, 12A Tiffany La., Smithtown, N.Y. 11787

[21] Appl. No.: 781,143

[22] Filed: Mar. 25, 1977

[51] Int. Cl.[2] ..... G06G 7/22; G10H 1/06

[52] U.S. Cl. ..... 364/827; 84/1.11; 84/1.19; 328/18; 364/817; 364/851; 364/419

[58] Field of Search ..... 235/193, 197, 151.31, 235/151.3; 324/77 R, 77 A, 77 B; 328/178, 187, 23, 180, 156, 14, 16–18, 22, 28, 30; 307/260, 261, 229, 230; 179/1 M, 1 D; 331/76; 84/1.01, 1.03, 1.04, 1.19, 1.22, 1.23, 1.11, DIG. 9

[56] References Cited

U.S. PATENT DOCUMENTS

| | | | |
|---|---|---|---|
| 3,006,228 | 10/1961 | White | 84/1.01 |
| 3,350,651 | 10/1967 | Davis | 328/16 X |
| 3,495,158 | 2/1970 | Garnett et al. | 328/16 |
| 3,535,969 | 10/1970 | Bunger | 84/1.11 |
| 3,729,683 | 4/1973 | Hemme | 328/14 X |
| 3,845,395 | 10/1974 | Murphree | 328/14 |

*Primary Examiner*—Joseph F. Ruggiero
*Attorney, Agent, or Firm*—Posnack, Roberts, Cohen & Spiecens

[57] ABSTRACT

Random audio signals are converted into sine-waves of corresponding frequency and duration, and harmonics are derived from the sine-waves. The harmonics are controllably attenuated and selectively inverted and combined to form an output signal. The conversion of the random signals is effected by squaring the same to drive a Schmitt trigger which feeds into a levelled integrator which leads to a diode function generator. The harmonics are generated with the use of four-quadrant multipliers.

7 Claims, 6 Drawing Figures

INTEGRATED CIRCUIT
+15V
-15V
$e_{OUT} = \frac{1}{2}$ SIN 2X
$e_{IN}$ = SIN X

STEP ATTEN.
STEP ATTEN.
NORMAL
INVERT
HARMONIC GENERATOR
SIN X
SIN 2X
SIN 5X
SIN 5X
SIN X

AUDIO SIGNAL PROCESSOR

FIELD OF THE INVENTION

This invention relates to signal processing apparatus and more particularly to circuits for generating musical tones.

BACKGROUND OF THE INVENTION

M. Mathews discloses in U.S. Pat. No. 3,819,861 apparatus for enhancing the sound quality of musical instruments. Electrical signals representative of sound are modulated in a predetermined manner to increase their spectral content and are then processed by a resonance network which alters the amplitude and phase relationships of the various harmonic signal components. The processed signals are then demodulated with the method re-creating a distorted replica of the original tone which is rich in harmonics that are uncorrelated in amplitude and in phase with each other. This patent, amongst other things, fails to show the control of amplitudes of the different frequencies and, consequently, is unlike the invention disclosed herein.

R. Deutch shows in U.S. Pat. No. 3,913,442 a computer organ of the type wherein a musical wave shape is synthesized by computing in real time the amplitude contributions of the constituent Fourier components and summing these to obtain each wave-shape sample point amplitude, the tonal quality or voice of the produced note being established by a set of harmonic coefficients that specify the relative amplitude of each Fourier component. Circuitry is disclosed for modifying the harmonic coefficient values to accomplish transient voice insertion including "chiff" and percussive transients to modulate the harmonic content as a function of time during attack and decay and to facilitate the external insertion of additional voices for the instrument. This circuitry is restricted to the keyboard and cannot handle outside signals, as a consequence whereof it is unlike the circuitry contemplated within the scope of the present invention.

SUMMARY OF INVENTION

It is an object of the invention to provide improved circuitry which is capable of accepting random signals in the audio music spectrum and to generate improved audio signals based thereon.

It is another object of the invention to provide improved audio signal processing circuits.

To achieve the above and other objects of the invention, there is provided a signal processing apparatus comprising means for accepting random signals of varying duration and frequency and generating therefrom regular signals of corresponding duration and frequency, second means for converting each of said regular signals into a plurality of harmonics thereof, and third means for respectively attenuating said harmonics and combining the same. The said first means may include means for generating the regular signals as sine and cosine waves. Means may be provided for inverting selected of the harmonics before the same are combined.

Said first means may include input amplifier means for amplifying said random signals and may also include squaring means for squaring the thusly amplified random signals, a Schmitt trigger driven by said squaring means, levelled integrator means coupled to said trigger and driven thereby to generate an output triangular wave of constant amplitude, and a diode function generator coupled to said levelled integrator means to generate a sine-wave corresponding to said triangular wave.

Said second means may include harmonic generator means coupled to said diode function generator and responsive thereto for generating said plurality of harmonics. Said third means may include a plurality of attenuators for receiving respective of said harmonics and controllably attenuating the same, and adder means for adding the thusly attenuated harmonics.

Said harmonic generator means may, for example, include means for converting sin x to sin 2x, means for converting sin x and sin 2x respectively into cos x and cos 2x, means for converting sin x and cos 2x into $A/2[\sin(x+2x)+\sin(x-2x)]$, means for converting cos x and sin 2x into $A/2[\sin(2x+x)+\sin(2x-x)]$ and means to add $A/2[\sin(x+2x)+\sin(x-2x)]$ and $A/2[\sin(2x+x)+\sin(2x-x)]$ to form sin 3x. This is exemplary of to how a series of harmonics may be generated for selective use with or without inversion and in an additive sense to form an output signal.

In further accordance with the invention, there is provided a method for converting signals of an audio music spectrum which method comprises converting the periodic signals into sine-waves of the same frequency and duration, deriving harmonics from the sine-waves, selectively attenuating the harmonics, and combining the thusly attenuated harmonics to obtain output signals. The input signals may be squared and converted into triangular waves from which the aforesaid sine-waves are derived.

The above and further objects, features and advantages of the invention will be described in greater detail below with reference to the accompanying drawing.

DETAILED DESCRIPTION

Figure 1:
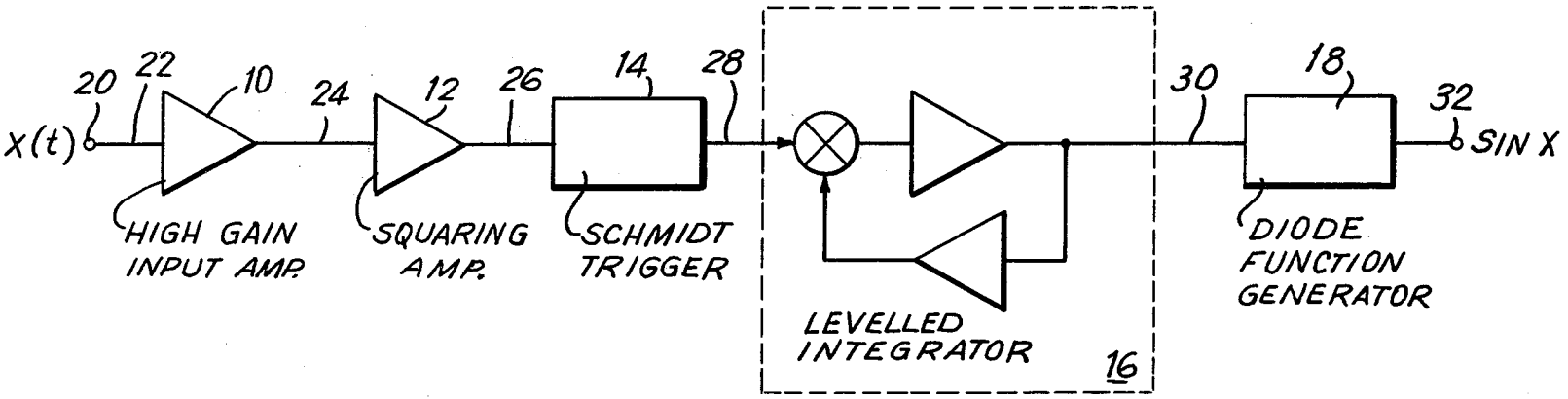
FIG. 1 is a diagrammatic illustration of input circuitry employed in the signal processor of the invention.

A circuit of this invention may be descriptively called a Fourier function generator. Its purpose is to generate complex waveforms by generating appropriate harmonics, and then adding them in proper amplitude and phase relationship to obtain a desired waveform. Each harmonic in the circuit of the invention can be controlled individually with respect to its relative amplitude and phase.

This circuit can be used with respect to electronic music to simulate the sound of various musical instruments. It can take an input from, for example, an electric guitar and convert the waveform to obtain a desired effect. The conversion is obtained via Fourier transform with the input signal causing, for example, the first five harmonics to be generated in the preferred embodiment.

In electronic organs, each tone and its harmonics are generated within the instrument. "Organ stops" preset the levels of the harmonics which are subsequently added together to produce a desired wave. This gives the instrument a wide tonal range. The device of this invention extends this capability to any instrument, voice-generated sounds, or any type of sound conversion.

In order to provide for functioning in accordance with the invention, an electronic signal obtained from an instrument or voice must first be converted into a sine-wave at the fundamental frequency yielding sin x. From sin x, all other harmonics are derived; i.e., sin 2x, sin 3x, . . . sin 5x inclusive.

The input circuitry of the invention is capable of accepting periodic signals, in the audio music spectrum, whose duration and frequency vary independently. The input circuitry processes the signal in such a way as to generate a sine-wave of the same frequency and duration. This is accomplished by amplifying, squaring, and then driving a Schmitt trigger to obtain a square wave. The square wave is fed to a levelled integrator whose output is a triangular wave of constant amplitude. The triangular wave is fed to a diode function generator whose output is a sine-wave. When the input signal goes below the biasing point of the Schmitt trigger, no further output is obtained.

Having obtained sin x, it is then necessary to generate the next four sequential harmonics. The generation of the harmonics forms the basis of one of the principles of the invention. Particularly, the invention provides for the generation of sin nx with any $x = \omega t$ in the audio range and preferably with n = 1 to 5. In general, the function is expressed as follows:

$$\sin(A+B) = \sin A \cos B + \cos A \sin B$$

or $$\sin(A+A) = 2 \sin A \cos A$$

More particularly, sin 2x is derived quite simply by feeding both ports of a four-quadrant multiplier since:

$$A \sin 2x = A/2[\sin(x+x) + \sin(x-x)$$

Generation of sin 3x follows from:

$$A \sin 3x = A/2\,[\sin(2x+x) + \sin(2x-x) + A/2\,[\sin(x+2x) + \sin(x-2x)] \quad (1)$$

Given that:

$$A \sin A \operatorname{Cos} B = A/2\,[\sin(A+B) + \sin(A-B)] \text{ (IDENTITY)} \quad (2)$$

Thus, if the function in equation (1) is implemented, the result is the third harmonic.

The fourth harmonic is derived from the second harmonic by "doubling". It is expressed as follows:

$$\sin(4x) = A/2[\sin(2x+2x) + \sin(2x-2x)] \quad (3)$$

The fifth harmonic is derived from the 3x, and third harmonics, namely:

$$\sin 5x = A/2[\sin(2x+3x) + \sin(2x-3x)] + A/2\,[\sin(3x+2x + \sin(3x-2x)] \quad (4)$$

The sixth and seventh harmonics could follow in similar order.

They would be respectively expressed as:

$$\sin 6x = A/2[\sin(3x+3x) + \sin(3x-3x)] \quad (5)$$

$$\sin 7x = A/2[\sin(3x+4x) + \sin(3x-4x)] + A/2\,[\sin(4x+3x) + \sin(4x-3x)] \quad (6)$$

A typical circuit for obtaining sin 3x, for example, is described below wherein equation (1) is implemented using standard circuits and networks. Amplifiers are appropriately used to adjust the amplitude and sign of signals relative to sin x. Levelled integrators are used to obtain cos x from sin x.

The output circuitry of the invention consists, for example, of individual step attenuators for each of the respective harmonics. Each attenuator can be set by the operator with the harmonics being added to produce the final wave-shape. This final wave is applied to an amplifier and the resultant sound will be substantially different than the original. If each step attenuator has seven positions and there are a total of five tones, the number of available combinations is $7^5$. Additional tones may be obtained by inverting each phase and making available to the operator the choice of which of the harmonics shall be inverted. This can be accomplished with five invertors and eight single-pole switches. This feature makes the total number of tone combinations nearly infinite.

The circuitry illustrated in FIG. 1 is the input circuitry contemplated in accordance with the preferred embodiment of the invention. The circuitry comprises a high gain input amplifier 10, a squaring amplifier 12, a Schmitt trigger 14, a levelled integrator 16 and a diode function generator 18. The details and operation of a typical diode function generator 18 can be found in "Operational Amplifiers" by Tobey-Graeme-Huelsman, McGraw-Hill, Page 254. Input signals which are periodic signals of the audio-music spectrum are received at input terminal 20 and are fed via line 22 to the high gain input amplifier 10. The thusly amplified signals are fed via line 24 to the squaring amplifier 12, wherefrom the output signals are fed via line 26 to the Schmitt trigger 14. The Schmitt trigger 14 feeds its output signals via line 28 to the levelled integrator 16 which generates a triangular wave. The triangular wave is fed via line 30 to the diode function generator 18, which generates an output wave at output terminal 32, which wave is sin x. The signals generated in levelled integrator 16 and diode function generator 18 are of the same frequency and duration as the periodic signals received at input terminal 20.

Figure 2:
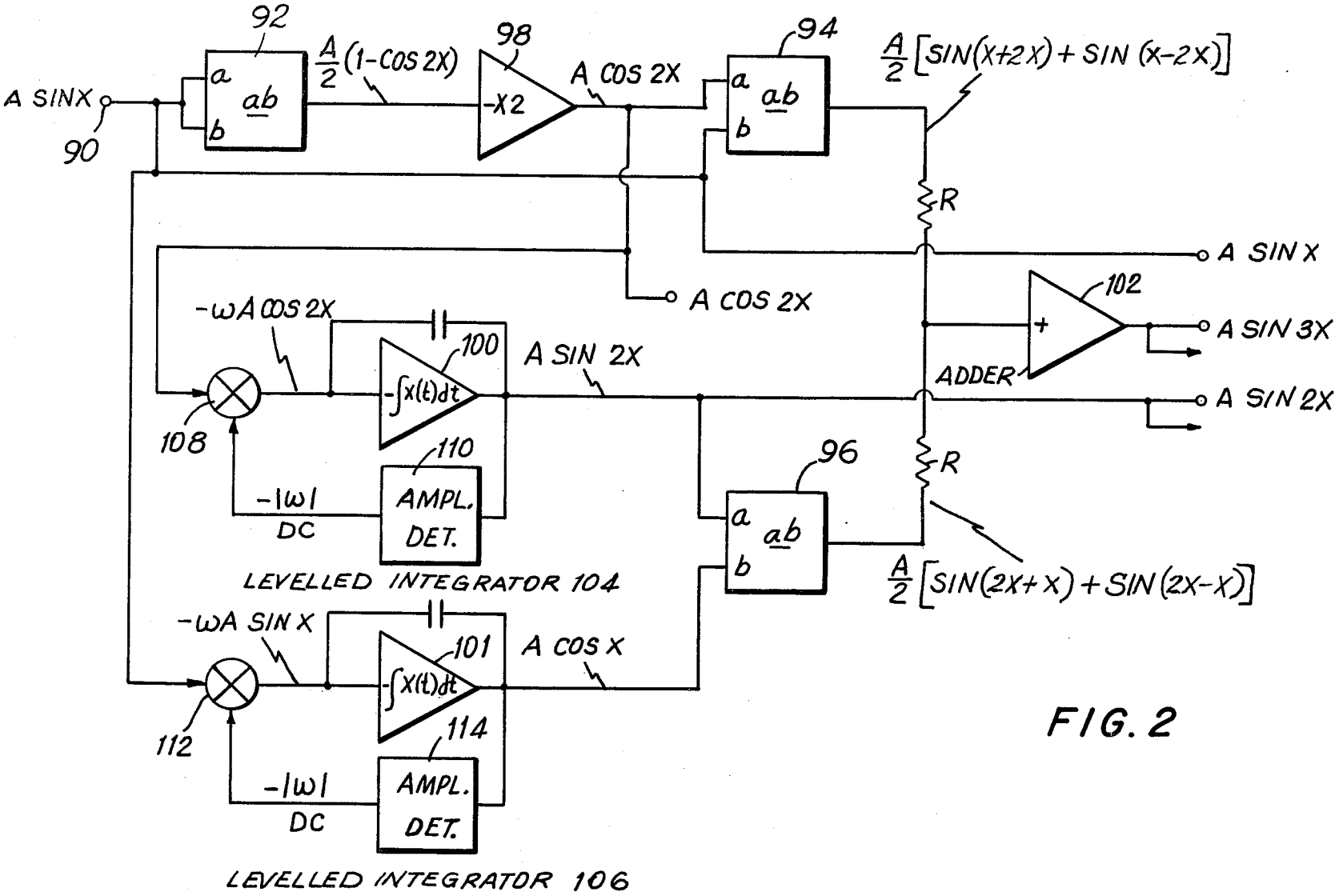
FIG. 2 is a block diagram of a circuit provided in accordance with the invention for producing second and third harmonic waves from the output of the circuit of FIG. 1.

The output of the circuit of FIG. 1 constitutes the sine-wave A sin x, which is fed into the input terminal 90 of FIG. 2, wherein is shown by way of example, a harmonic generator employed in accordance with the invention. This circuit comprises, by way of example and without limitation, a four-quadrant multiplier 92, a four-quadrant multiplier 94 and a four-quadrant multiplier 96. The circuit, which effects trigonometric multiplication, furthermore includes amplifiers 98, 100, 101 and 102. Integrators 104 and 106 include amplifiers 100 and 101 respectively. Associated with amplifier 100 are gate 108 and amplitude detector 110. Associated with amplifier 101 are gate 112 and amplitude detector 114.

Input signal A sin x is applied to both inputs of four-quadrant multiplier 92 which is configured as a frequency doubler. At the output of four-quadrant multiplier 92, there appears:

$$A/2 \sin^2 x = A/2(1-\cos 2x)$$

Amplifier 98 serves to block the D.C. component in the above equation while inverting and restoring the amplitude to +A. Signal A cos 2x is then applied to the "a" input of four-quadrant multiplier 94. Signal A sin x is applied to the "b" input of four-quadrant multiplier 94. The output of four-quadrant multiplier 94 then becomes:

$$ab = A/2 \sin x \cos 2x$$

$$= A/2\,[\sin(x+2x) + \sin(x\text{-}2x)]$$

The signal of the above equation is applied to one input of the summing amplifier 102. Gate 108, amplifier 100 and detector 110 form the levelled integrator 104. One input of gate 108 receives signal A cos 2x from amplifier 98 and a D.C. level proportional to $-|\omega|$ at its second input. The output of gate 108 is controlled by the D.C. level at the latter input such that the amplitude of signal at the gate 108 output is a function of $-|\omega|$ and appears as:

$$v_o = -\omega A \cos 2x$$

Amplifier 100 functions as an integrator and operates on the signal output of gate 108 as follows:

$$-\int v_o dt = -\omega A \int \cos 2x\, dt$$

(Let $2x = \omega t$, then)

$$= -\omega A \int \cos \omega t\, dt$$

$$= -(\omega A/\omega) \int \cos \omega t \cdot \omega dt$$

$$= A \sin \omega t$$

$$= A \sin 2x \ldots$$

Signal A sin 2x thus obtained is applied to the "a" input of four-quadrant multiplier 96. Signal A sin x is applied to the levelled integrator 114 formed by gate 112, amplifier 101 and detector 114. The operations of this circuit is identical to that described previously except that signal A sin x is applied to one input of gate 112. At the output of amplifier 101, there results A cos x which is applied to four-quadrant multiplier 96. The output of this circuit gives rise to:

$$ab = A/2 \sin 2x \cos x$$

$$= A/2\,[\sin(2x+x) + \sin(2x-x)]$$

The latter output signal from circuit 96 is applied to the other input of summing amplifier 102. This amplifier performs an algebraic addition of the two signals applied to it. Specifically:

$$v_{o_{Al}} = A/2\{[\sin(x+2x) + \sin(x-2x)] + [\sin(2x+x) + \sin(2x-x)]\}$$

Combining like terms in this equation:

$$v_{o_{Al}} = A/2[2 \sin(3x)] + A/2[\sin x + \sin -x]$$

$$= A \sin 3x$$

Figure 3:
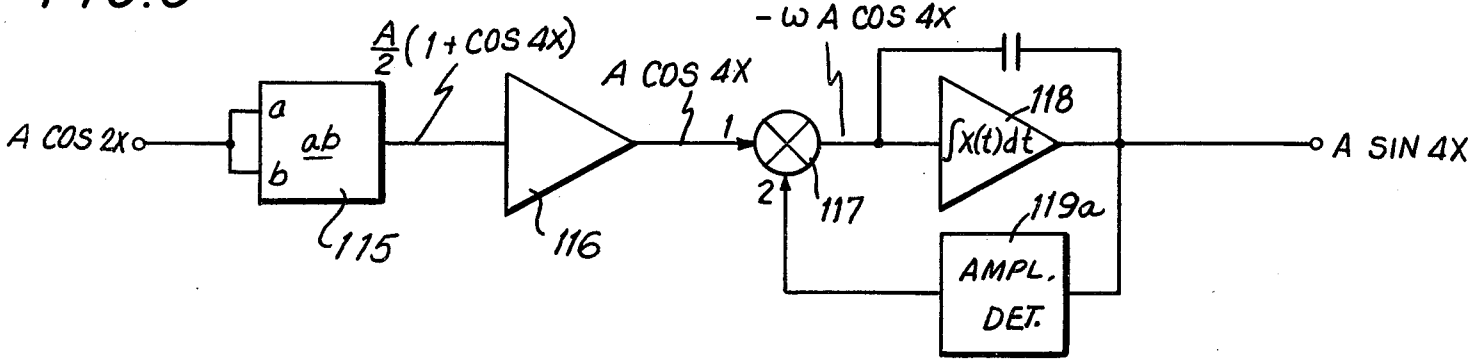
FIG. 3 is a circuit for producing the fourth harmonic.

In FIG. 3, signal A cos 2x is applied to both inputs of four-quadrant multiplier 115. Four-quadrant multiplier 115 is configured as a frequency doubler. At the output of four-quadrant multiplier 115 there appears:

$$A/2 \sin^2 2x = A/2\,(1 + \cos 4x)$$

Amplifier 116 serves to block the D.C. term in the above equation while inverting and restoring the amplitude to +A. Signal A cos 4x is then applied to the levelled integrator formed by gate 117, amplifier 118 and detector 119*a*. Operation of the levelled integrator is identical to that described above except that signal A cos 4x is applied to one input of gate 117. The output of amplifier 118 then becomes A sin 4x.

Figure 4:
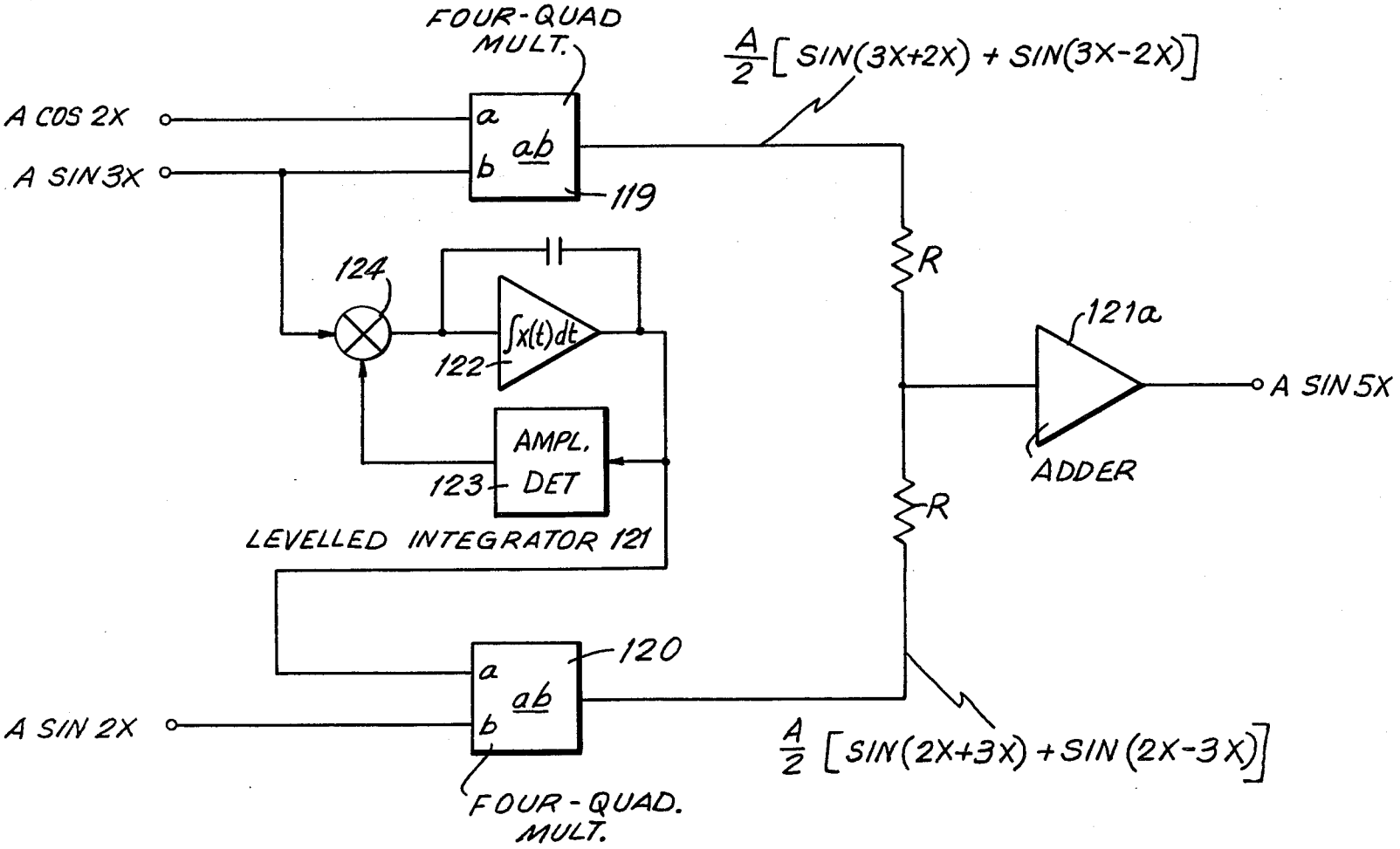
FIG. 4 is a circuit for producing the fifth harmonic.

The operation of the circuit of FIG. 4 is similar to that described for FIG. 2. The circuit includes a levelled integrator 121 including amplifier 122, detector 123 and gate 124. The object of the circuit of FIG. 4 is to obtain A sin 5x from signals A cos 2x, A sin 3x and A sin 2x. At the output of four-quadrant multiplier 119 there appears:

$$ab = A/2 \sin 3x \cos 2x$$

$$= A/2[\sin(3x+2x) + \sin(3x-2x)]$$

At the output of four-quadrant multiplier 120 there appears:

$$ab = A/2 \sin 2x \cos 3x$$

$$= A/2[\sin(2x+3x) + \sin(2x-3x)]$$

When the signals of the two above equations are added algebraically by amplifier 121*a*, the result is:

$$v_{o_{AB}} = A \sin 5x$$

Figure 5:
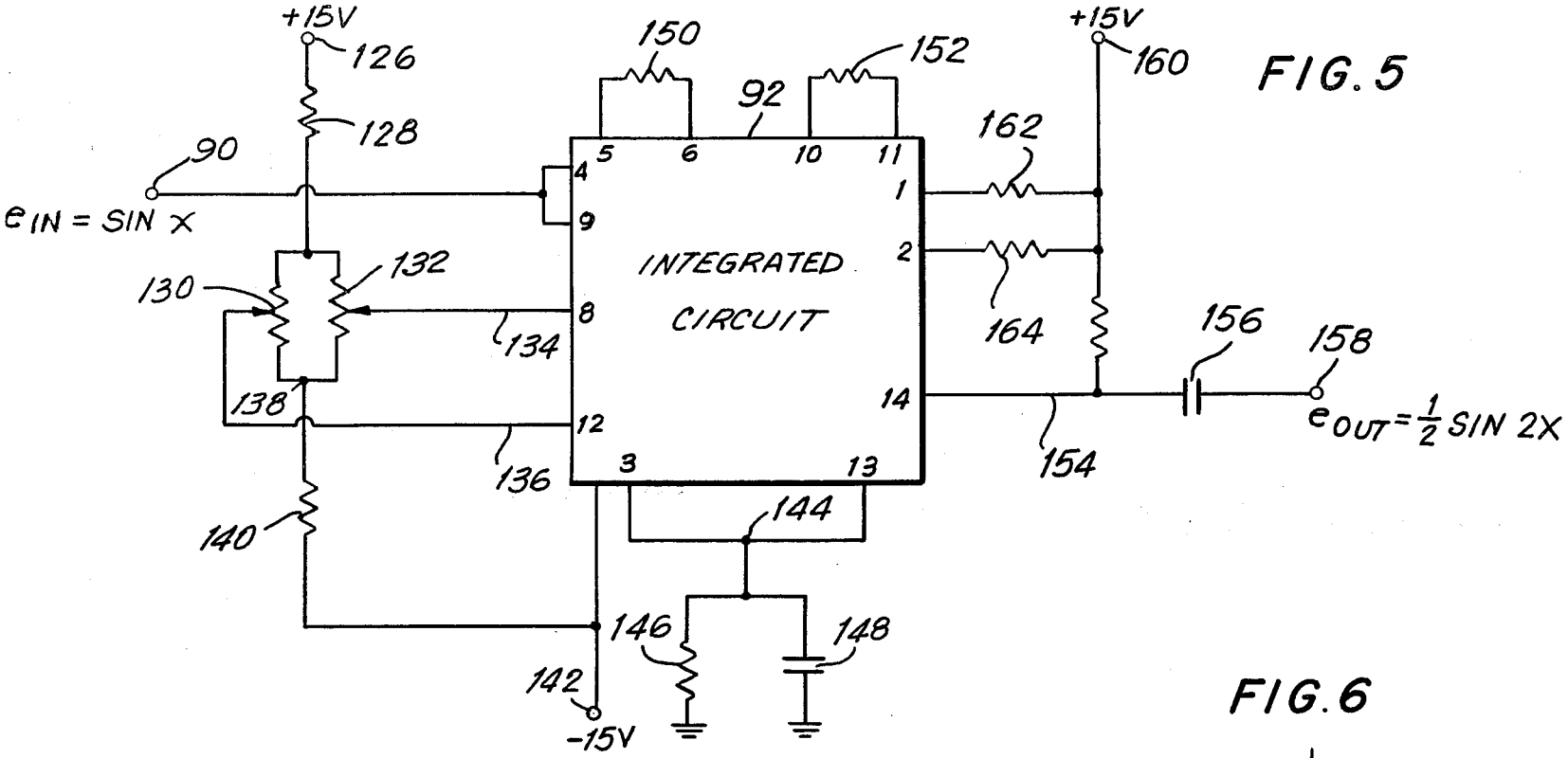
FIG. 5 illustrates the details of a four-quadrant multiplier circuit employed in the aforementioned harmonic generators.

A typical four-quadrant multiplier circuit is illustrated in FIG. 5 wherein is shown the chip or integrated circuit constituting a frequency doubler and commercially available as MC1595(Mot.). Thus, for example, with reference to FIG. 2, there is seen the same input terminal 90 which feeds its input signal into the four-quadrant multiplier 92. A positive voltage is applied to terminal 126 which is connected via resistor 128 to two potentiometers 130 and 132 connected in parallel. The tap of potentiometer 132 is connected via line 134 as an input to four-quadrant multiplier 92. The tap of potentiometer 130 is connected via line 136 as a further input to the four-quadrant multiplier 92. Potentiometers 130 and 132 serve to null the input offset voltage.

Potentiometers 130 and 132 are connected to a common junction 138 connected via resistor 140 to a negative voltage supply, which is applied to terminal 142. Other terminals of multiplier 92 are connected to a common junction 144 and via resistor 146 and capacitor 148, connected in parallel, to ground.

Resistors 150 and 152 are connected across other terminals of the multiplier 92 and outputs appear on line 154 passing through capacitor 156 to output terminal 158. A positive voltage is also applied to terminal 160 and via resistors 162 and 164 to terminals of the foresaid multiplier.

Figure 6:
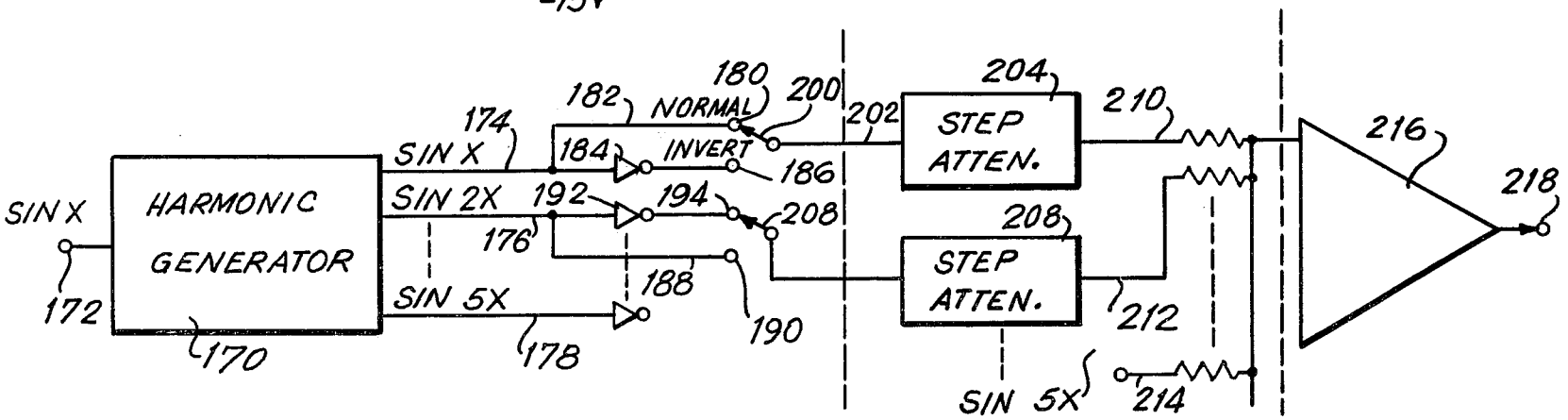
FIG. 6 is a diagrammatic illustration of the output circuitry of the invention.

The output circuitry of the apparatus of the invention is illustrated in FIG. 6 where also appears the harmonic generator shown, at least in part in detail in FIG. 3. The harmonic generator is indicated by reference 170 and receives sin x from input terminal 172. The harmonic generator generates its output signals on separate parallel lines, indicated at 174, 176 and 178, these representing illustratively sin x, sin 2x, . . . sin 5x.

Referring firstly to line 174, this is connected directly to a normal terminal 180 via line 182 but through an inventor 184 to an invert terminal 186. Sin 2x is similarly connected directly via line 188 to a normal terminal 190 and via an invertor 192 to an invert terminal 194. The other terminals in the series are likewise connected.

Referring, for example, to the single pole switch 200, this is illustrated as being selectively connected to normal terminal 180 and in turn being connected via line 202 to step attenuator 204 consisting, for example, of seven steps. Single pole switch 206 is likewise connected to a step attenuator 208, as are the rest of the single pole switches associated with each of the other lines (not shown).

The signals are collectively attenuated and selectively inverted or not and fed via respective lines illustrated, by way of example, by lines 210, 212 and 214, these being three of the lines respectively associated with sin x, sin 2x . . . sin 5x. Output adder 216 provides for adding the signals together to provide an output signal appearing on output terminal 218 and applicable to an amplifier for purposes of producing a musical tone consisting of the combined harmonics generated from the original random signals.

From what has been indicated above, it will now appear that the invention provides a method for converting signals of an audio-music spectrum which method comprises converting the signals into sine-waves of the same frequency and duration as said input signals, deriving harmonics from the sine-waves, selectively attenuating the harmonics, and combining the thusly attenuated harmonics to obtain output signals. The random signals may particularly be squared and converted into triangular waves from which the sine-waves are derived.

In accordance with the invention, there is provided signal processing apparatus comprising first means for accepting input signals of varying duration and frequency and generating therefrom regular signals of corresponding duration and frequency, second means for converting each of said regular signals into a plurality of harmonics thereof, and third means for respectively attenuating the said harmonics and combining the same. Said first means may include a means for generating the regular signals as sine and cosine waves. There may be provided means for inverting selected of said harmonics before the said are combined.

There will now be obvious to those skilled in the art many modification and variations of the circuits and methods set forth here and above. These modifications and variations will not depart from the scope of the invention if defined by the following claims.

What is claimed is:

1. Signal processing apparatus comprising first means for accepting music signals of respective durations and frequencies and generating therefrom sinusoidal signals of corresponding durations and frequencies, second means for converting each of said sinusoidal signals into a plurality of harmonics thereof, and third means for respectively attenuating the said harmonics and combining the same, said second means including harmonic generator means responsive to said sinusoidal signals for generating said plurality of harmonics, said third means including a plurality of attenuators for receiving respective of said harmonics and controllably attenuating the same and adder means for adding the thusly attenuated harmonics, said sinusoidal waves being of the form A sin x and said harmonic generator means including means for converting A sin x to A cos 2x, means for converting sin x and A cos 2x into A/2, means for converting A sin x and A cos 2x respectively into A cos x and A sin 2x, means for converting A cos x and A sin 2x into A/2 and means to add A/2 and A/2 to form A sin 3x.

2. Signal processing apparatus as claimed in claim 1, wherein said first means includes a means for generating the sinusoidal signals as sine and cosine waves.

3. Signal processing apparatus as claimed in claim 1, comprising means for inverting selected of said harmonics before the same are combined.

4. Signal processing apparatus as claimed in claim 1, wherein said first means includes input amplifier means for amplifying said input signals, squaring means for squaring the thusly amplified input signals, a Schmitt trigger driven by said squaring means, levelled integrator means coupled to said trigger and driven thereby to generate an output triangular wave of constant amplitude, and a diode function generator coupled to said levelled integrator means to generate a sine wave corresponding to said triangular wave.

5. Signal processing apparatus as claimed in claim 1 comprising means coupling said harmonic generator means to said attenuators and selectively inverting said harmonics.

6. Signal processing apparatus as claimed in claim 1 further comprising means for converting A cos 2x to A cos 4x and the latter to A sin 4x.

7. Signal processing apparatus as claimed in claim 6 further comprising means to convert A cos 2x, A sin 3x and A sin 2x into A sin 5x.

* * * * *